United States Patent [19]

Pirc

[11] Patent Number: 4,799,901

[45] Date of Patent: Jan. 24, 1989

[54] ADAPTER HAVING TRANSIENT SUPPRESSION PROTECTION

[76] Inventor: Douglas J. Pirc, 75 Black Walnut Dr., Etters, Pa. 17319

[21] Appl. No.: 213,643

[22] Filed: Jun. 30, 1988

[51] Int. Cl.[4] ..... H01R 13/66

[52] U.S. Cl. ..... 439/620; 333/185

[58] Field of Search ..... 333/181–185; 439/92, 108, 344, 676, 620

[56] References Cited

U.S. PATENT DOCUMENTS

| | | | |
|---|---|---|---|
| 4,153,327 | 5/1979 | Johnson | 439/344 |
| 4,273,402 | 6/1981 | Hughes | 439/344 |
| 4,392,701 | 7/1983 | Weidler | 439/405 |
| 4,695,105 | 9/1987 | Ney et al. | 439/620 |
| 4,726,638 | 2/1988 | Farrar et al. | 439/608 |
| 4,729,743 | 3/1988 | Farrar et al. | 439/620 |
| 4,729,752 | 3/1988 | Dawson, Jr. et al. | 439/620 |

*Primary Examiner*—Gary F. Paumen

*Attorney, Agent, or Firm*—Katherine A. Nelson

[57] ABSTRACT

An electrical adaptor 10 for providing transient suppression capabilities comprises housing members 12, 30, first and second connector subassemblies 44, 68, and dielectric subassembly 90 including dielectric substrate member 89 having electrical circuit component members 108 mounted thereon and means for grounding adaptor 10. First and second connector subassemblies 44, 68 include, respectively, first and second terminal members 46, 70 and first and second dielectric support members 52, 70. Dielectric substrate 89 includes a plurality of conductors 92 having first, second, and intermediate portions 94, 96, and 98 respectively and ground conductive area 102. First and second connector subassemblies are mounted to substrate 89 such that first and second terminal members 46, 70 are in electrical engagement with first and second conductor portions 94, 96 respectively. Components 108 are mounted to substrate 89 and are in electrical engagement with intermediate conductor portion 98 and ground area 102, thus providing protection from power surges for connectors mated to first and second connector subassemblies 44, 68 respectively.

20 Claims, 4 Drawing Sheets

10
12
20
18
26
14
68
76
82
14
24
16
124
22
122
120
70
74
78
86
88
44
58
122
126
54
89
52
91
56
110
108
60
64
62
112
116
40
118
114
38
30
34
36
36
32
38
40

ADAPTER HAVING TRANSIENT SUPPRESSION PROTECTION

FIELD OF THE INVENTION

This invention relates to electrical connectors and more particularly to adapters for providing filtering and/or transient suppression capabilities for existing data communication systems and the like.

BACKGROUND OF THE INVENTION

Electrical circuitry often must be protected from damage caused by power surges owing to electrostatic discharges (ESD) and electromagnetic pulses (EMP). The high voltage generated by ESD and EMP can damage voltage sensitive integrated circuits and the like. Means for protecting against power surges include the use of additional specialized circuitry within equipment, such as voltage variable resistors. Protection can be achieved by the use of connectors or adapters having transient suppression and filtering devices therein, thereby eliminating the need for costly and extensive modification of the equipment itself. U.S. Pat. Nos. 4,726,638 and 4,729,752 are representative of connectors having such protection.

While it is possible to design new equipment with specialized circuits for protection from power surges, it is also desirable to provide protection for existing equipment and/or provide additional protection for sensitive electronic equipment. Often there is a need to interconnect a plurality of pieces of electronic equipment together. The equipment may be wired directly or interconnected through the use of one or more adapters. If the equipment itself does not have protection from power surges, or additional protection is desired, these adapters may be provided with such protection.

One major area of concern in today's electronic world is in the transfer of information between computers through the use of modems, which interconnect two or more computers via telephone lines. Frequently, it is desirable to provide additional protection for these computers from power surges that may occur during the transmission and receiving of information via the modem. The present invention provides an adapter for use with modems.

Adapters for interconnecting phone lines are known in the art. U.S. Pat. Nos. 4,153,327; and 4,273,402 disclose two such examples. The connectors or adapters are comprised of a housing having two plug receiving openings and a plurality of connector receiving channels extending between the openings and a plurality of continuous conductors, each conductor being disposed in a respective channel, the conductors being electrically connectable to corresponding conductors in modular plugs that are received in the openings These adaptors, however provide no protection from power surges.

U.S. Pat. No. 4,726,638 discloses a transient suppression assembly for retrofitting existing electrical connectors, such as a telephone jack. The transient protection devices are mounted to a substrate that is securable to an preexisting housing.

SUMMARY OF THE INVENTION

It is an object of the present invention to provide an adaptor for interconnecting two pieces of electronic equipment while providing protection for that equipment from power surges.

It is a further object of the invention to provide protection from power surges for electronic equipment that is interconnected through the use of modems.

It is also an object of the invention to provide a cost effective means for protecting electronic equipment from power surges without the need for modifying the equipment itself.

It is an additional object of the invention to provide protection from power surges by means of an "in line" coupler.

The present invention is directed to an electrical adaptor providing transient suppression capabilities for electronic equipment and particularly between pieces of electronic equipment. The adaptor comprises a dielectric substrate member having a plurality of conductors thereon, first and second connector subassemblies electrical circuit component members and means for grounding the component members. The conductors on the substrate have first, second and intermediate portions. The electrical circuit component members have first and second conductive portions. The component members are mounted to the substrate such that respective first conductive portions are in electrical engagement with the intermediate portion of a respective one of the substrate conductors. The second conductive portions of the component members are in electrical engagement with the grounding means.

The first connector subassembly includes a plurality of first terminal members having first and second connecting portions and a first dielectric support member, the first terminal members being disposed in the first support member. The first support member is configured to mate with a first complementary mating connector such that the first connecting portions of the plurality of first terminal members are electrically engaged with respective complementary terminal members. The first connector subassembly is mounted to the substrate member such that the second connecting portions of the first terminal members are electrically connected to respective first portions of the substrate conductors.

The second connector subassembly comprises a plurality of second terminal members having first and second connecting portions and a second dielectric support member. The second terminal members are disposed in the second support member. The second support member is configured to mate with a second complementary mating connector such that the first connecting portions of the plurality of second terminal members are electrically engaged with respective complementary terminal members. The second connector subassembly is mounted to the substrate member such that the second connecting portions of the second terminal members are electrically connected to respective second portions of the substrate conductors, thus electrically interconnecting respective first and second terminal members of the first and second connector subassemblies.

The adaptor further includes means for housing the substrate member, first and second connector subassemblies and the electrical circuit component members. In the preferred embodiment the housing is comprised of upper and lower housing members.

DETAILED DESCRIPTION OF THE DRAWINGS

Figure 1:
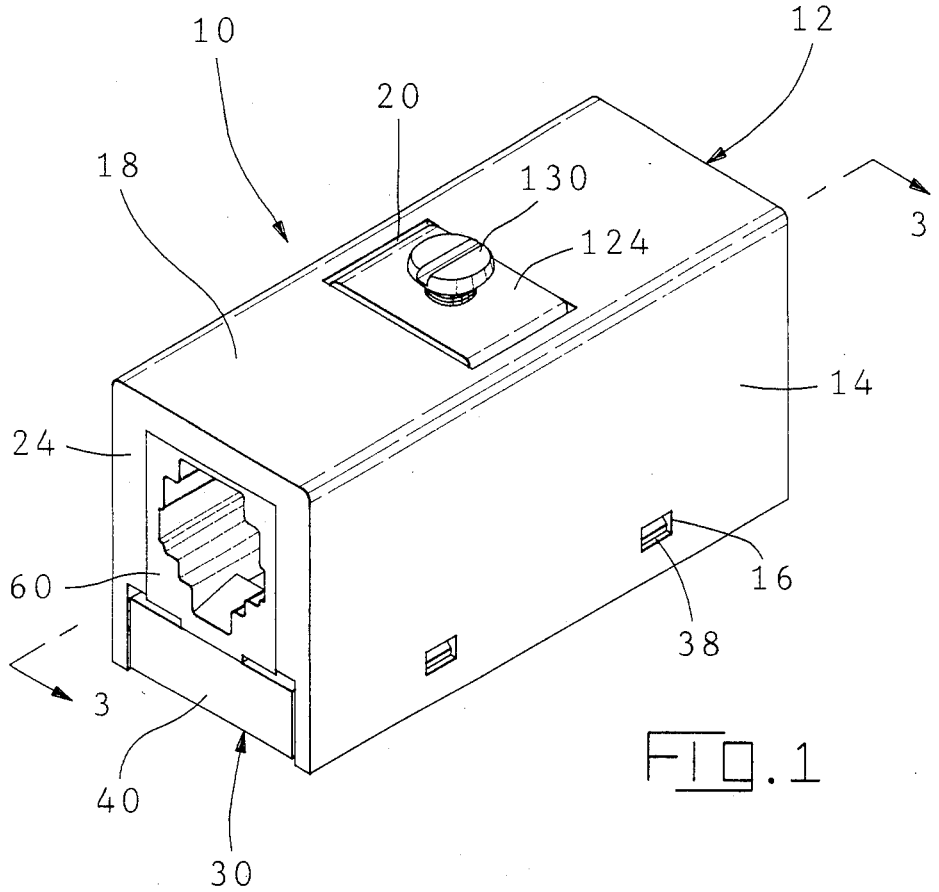
FIG. 1 is a perspective view of the assembled electrical adaptor of the present invention.
Figure 2:
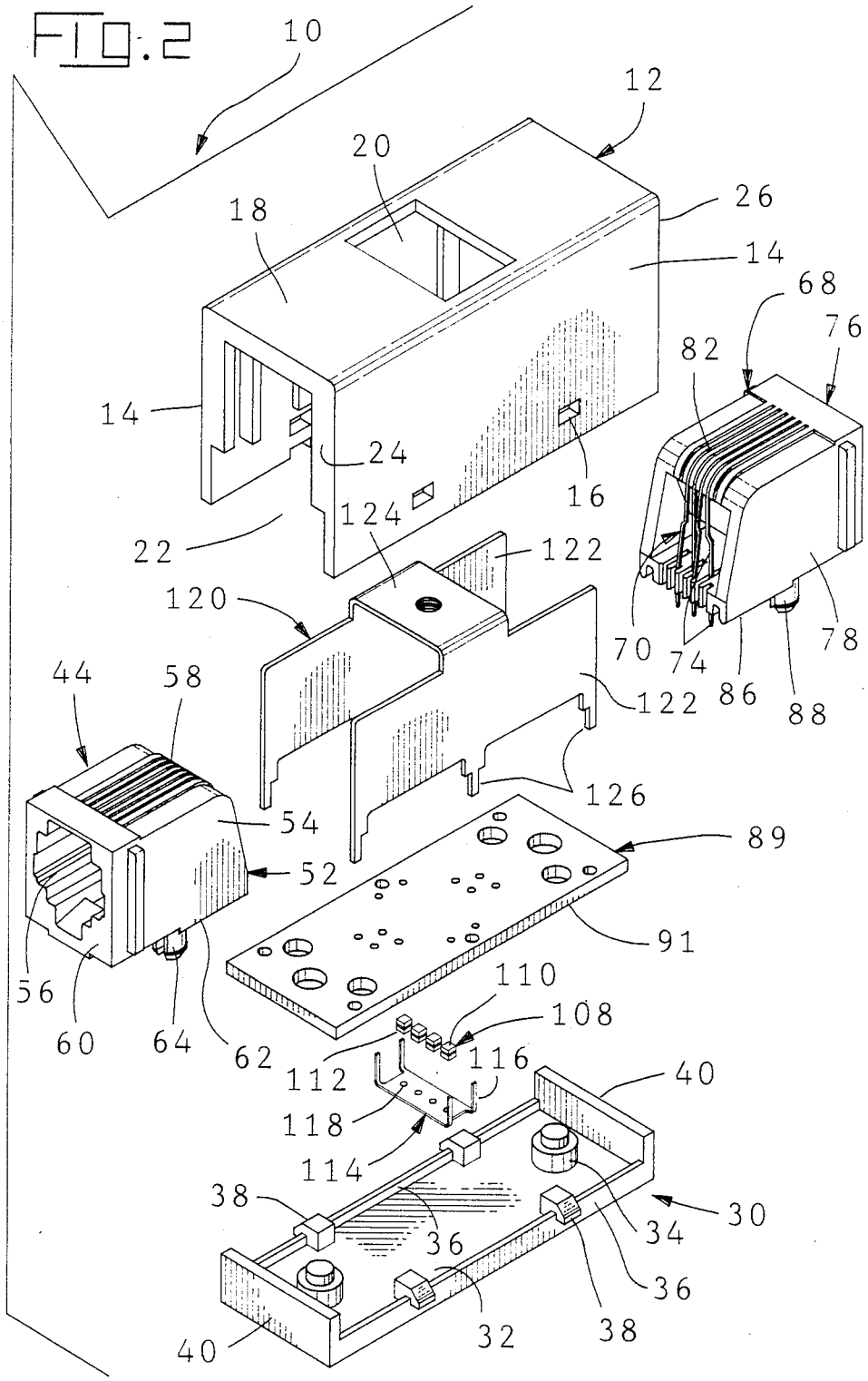
FIG. 2 is a exploded view of the adaptor of FIG. 1.
Figure 3:
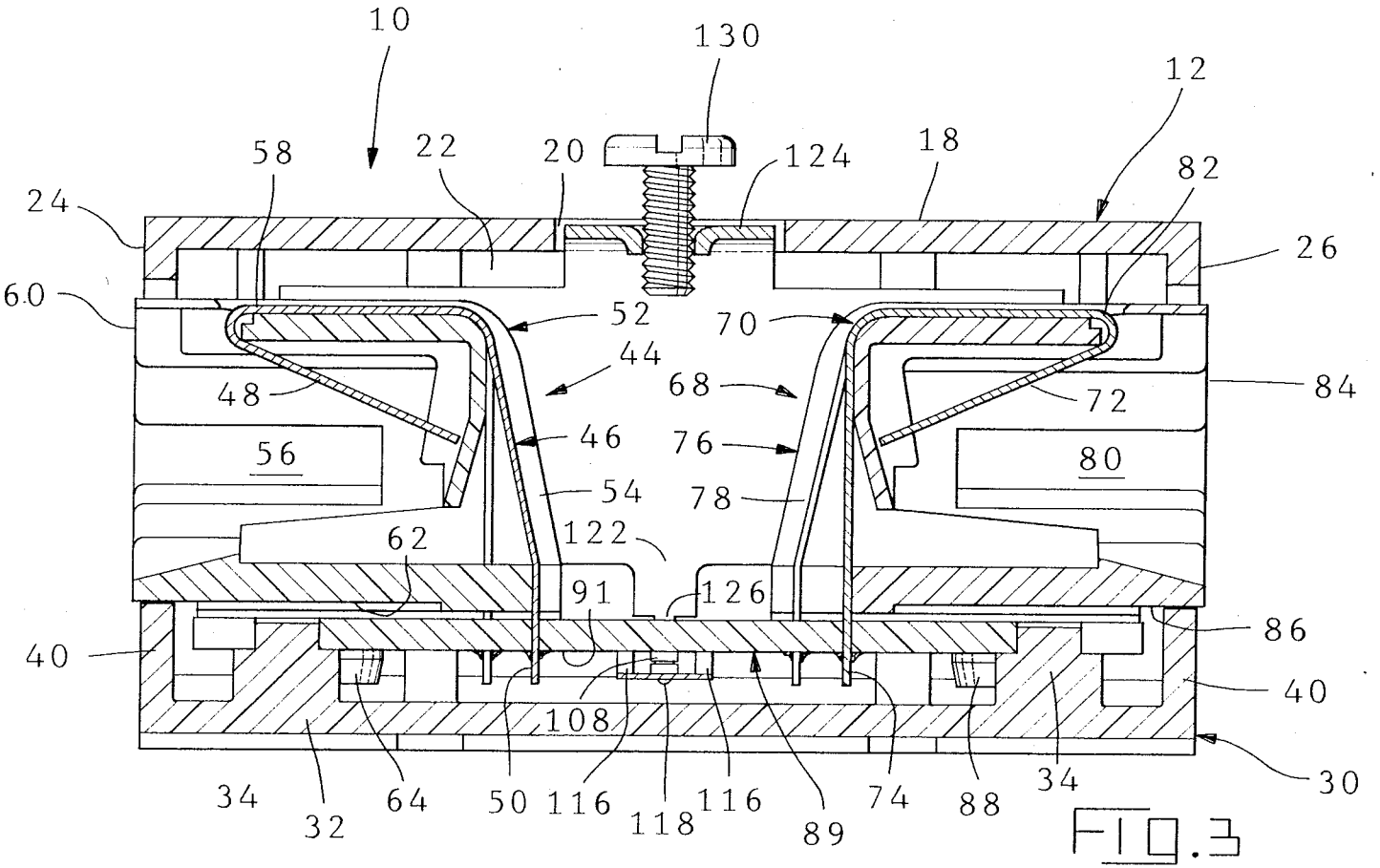
FIG. 3 is a cross-sectional view of the adaptor of FIG.

Referring now to FIGS. 1-3, electrical adaptor 10 is comprised of dielectric housing means having upper and lower housing members 12, 30; first and second connector sub-assemblies 44, 68; dielectric substrate subassembly 90 having electrical circuit component members 108 mounted thereon and means for grounding. For purposes of illustration, adaptor 10 is shown as a telephone coupler wherein first and second connector subassemblies 44, 68 are of modular jack configuration. It is to be understood that other configurations of connector subassemblies may be used in accordance with the invention.

Upper housing member 12 is comprised of opposed side walls 14 and top wall 18, which define cavity 22 dimensioned to receive first and second subassemblies 44, 68 and dielectric substrate subassembly 90 therein. Cavity 22 extends from a first mating face 24 to a second mating face 26. First and second mating faces 24 and 26 cooperate with respective first and second connector subassembly 44, 68 to provide an interconnection to corresponding mating connectors (not shown). Side walls 14 include locking apertures 16 which cooperate with locking means on lower housing member 30 to form the enclosed adaptor 10. Top wall 18 further includes aperture 20, which provides access to the grounding means of adaptor 10.

Lower housing member 30 is comprised of bottom wall 32 having up standing side walls 36 and end walls 40. Bottom wall 32 also includes substrate engaging means 34 and side walls 36 includes locking means 38 which cooperate with locking apertures 16 on upper housing member 12.

First connector subassembly 34 is comprised of a plurality of first terminal members 46 having first and second connecting portions 48, 50, respectively, disposed in first dielectric support member 52. First support member 52 is comprised of a body 54 having a plurality of terminal receiving passageways 58 therein, front face 60, and lower surface 62. First terminal members 46 are disposed in passageways 58 such that the first connecting portion is engagable with a mating connector (not shown). Mounting legs 64 for mounting first connector subassembly 44 to substrate member 89 extend downwardly from lower surface 62. Support member 52 is configured to mate with a first complimentary mating connector (not shown) such that the first connecting portion 48 of the plurality of first terminal members 46 electrically engaged respective complimentary terminal members of the mating connector.

Second connector subassembly 68 is comprised of a plurality of second terminal member 70 having first and second connecting portion 72, 74 respectively disposed in a second dielectric support member 76. Member 76 is comprised of a body 78 having a plurality of terminal receiving passageways 82, front face 84 and lower surface 86. Second mating connector subassembly 68 is configured to mate with a second complimentary mating connector (not shown) such that first connecting portion 72 of terminal members 70 are electrically engaged with respective complimentary terminal members of the mating connector. In the embodiment shown, first and second connector subassemblies 44, 68 are identical. It is to be understood that the first and second connector subassemblies need not be identical, for example one may be a plug assembly and one may be configured as a receptacle.

Dielectric substrate member 89 has a plurality of conductors 92 having first second and intermediate portions 94, 96, 98 respectively disposed on surface 91 thereof. First and second conductor portions 94, 96 include mounting areas, shown as apertures 95, 97, for interconnecting to respective second terminal portions 50, 74 of first and second connector subassemblies 44, 68, respectively. Intermediate conductor portion 98 includes a conductive pad area 99 for mounting electrical circuit component members 108 thereon. Dielectric substrate member 89 further includes ground conductive area 102, which extends over the majority of surface 91 except for a dielectric area 93 that surrounds the immediate area wherein conductors 92 are disposed. Substrate member 89 further includes mounting apertures 103, 104 for mounting first and second conductor subassemblies 44, 68, respectively. Substrate member 89 also includes apertures 105 for receiving locking means 38 of lower housing member 30 When adaptor 10 is assembled and apertures 106 for interconnecting to grounding means for adaptor 10. In the preferred embodiment, dielectric substrate member 89 is a single sided circuit board having both the ground conductive area 102 and circuit connectors 92 on one side thereof. It is to be understood that a ground conductor or area and/or circuit conductors may be placed on opposite sides of the board.

Figure 6:
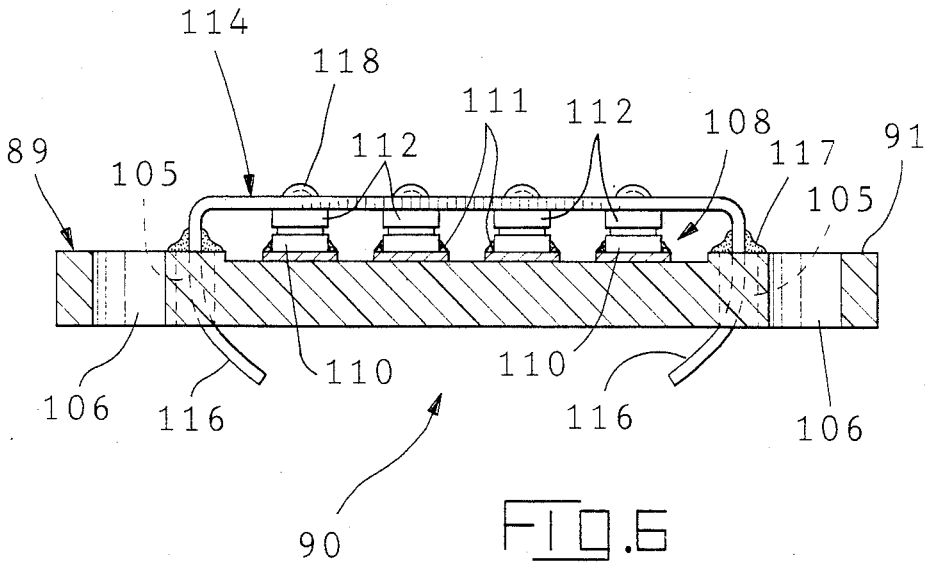
FIG. 6 is a cross sectional view of the substrate having the electrical component members and the accompany strap mounting thereon.
Figure 4:
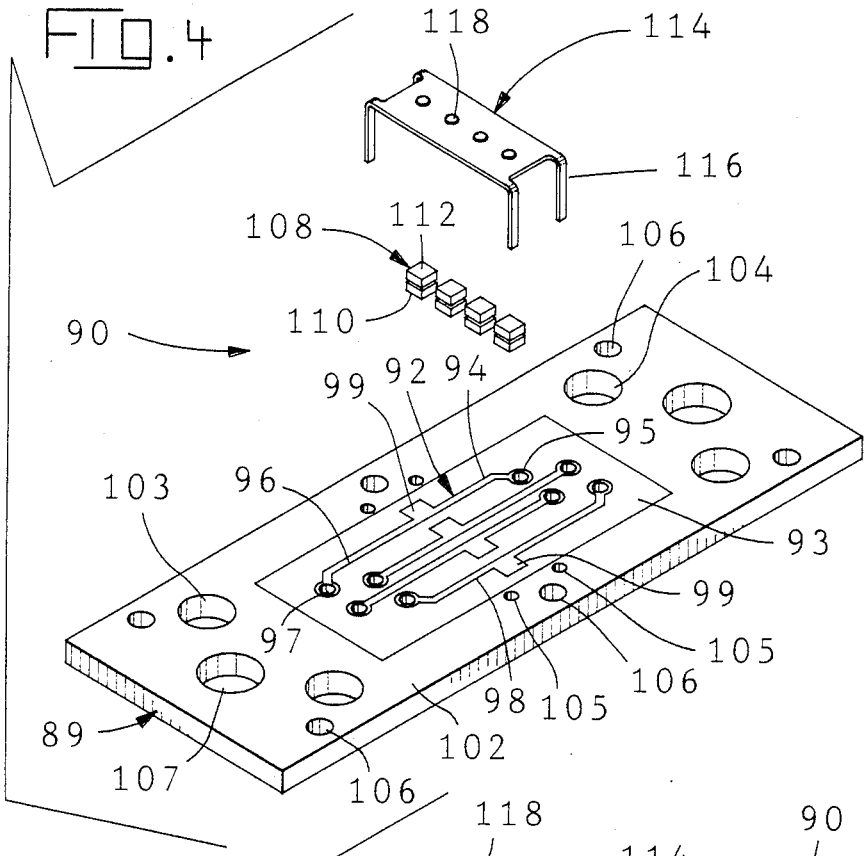
FIG. 4 is an exploded view of the underside of a substrate assembly in accordance with the present invention.
Figure 5:
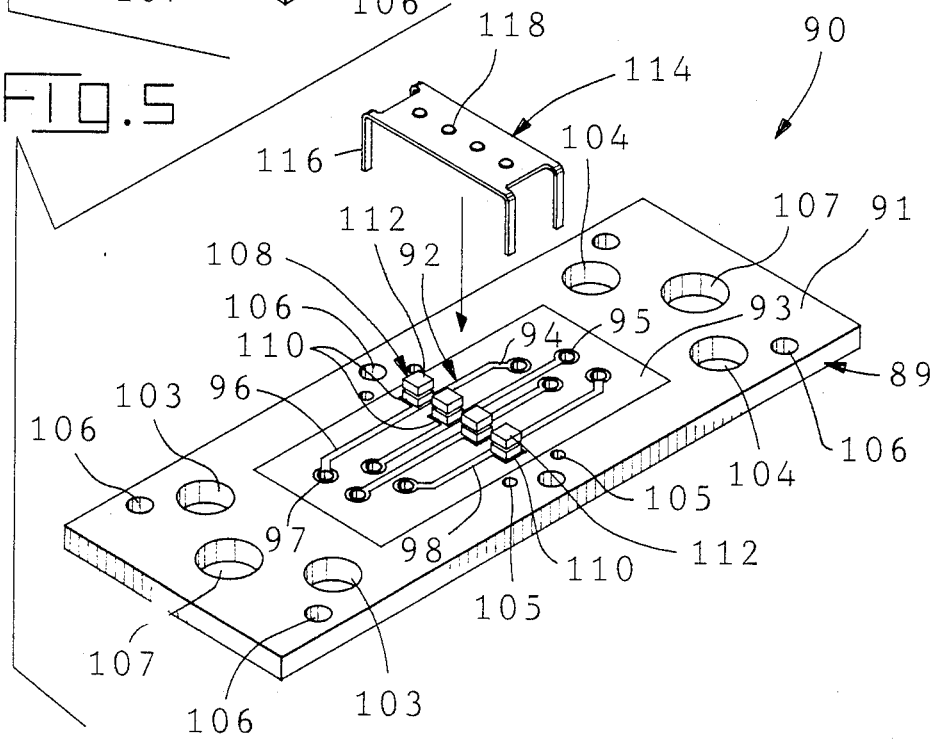
FIG. 5 is a partially assembled view of the substrate of FIG. 4.

Electrical circuit component 108 is a surface mountable chip member having conductive areas 110 and 112 disposed on opposed surfaces thereof. In the embodiments shown, surface 110 of component 108 is mounted on and electrically connected to conductive pad area 99 of intermediate conductor portion 98. In the preferred embodiment, electrical circuit component members 108 are mounted to the undersurface of dielectric substrate member 89. The structure of dielectric subassembly 90 is best seen by referring to FIGS. 3, 4, and 5. Second conductive surfaces 112 of electrical circuit component members 108 are electrically connected to ground thru means of a grounding strap 114 having legs 116 extending downwardly therefrom, legs 116 being electrically engaged to the ground area 102 through ground apertures 106 on dielectric substrate member 89. Ground strap 114 further includes a plurality of dimples 118, which are used in the assembly operation to hold solder or conductive adhesive for securing electrical circuit component members 108, as best seen in FIG. 6. In addition, dimples 118 provide a means for locating the position of the component members on ground strap 114, thus assuring proper aligning of the component members on pads 99 of the substrate.

Electrical connection to an external ground circuit is achieved by use of a metal ground shield 120 having opposed sides 122, top cross bar member 124, and a plurality of legs 126 extending downwardly from 122. Top cross bar member 124 includes aperture 125 for receiving grounding screw 130 or the like for connection to an external ground. Ground shield 120 is mounted to substrate 89 such that legs 126 engage ground apertures 106 with sides 122 extending along the side of first and second connector subassemblies 44, 68. When adaptor 10 is assembled cross bar member 124 lies within aperture 20 of upper housing member 12.

Adaptor 10 is assembled by mounting electrical circuit component members 108 and ground strap 114 to substrate member 89. As previously discussed, electrical circuit component members 108 are preferably secured to strap by means of solder or adhesive applied to dimples 188 on strap 114. The strap-component unit is then mounted to the substrate. Mounting legs 64, 88 of first and second connector subassemblies 44, 68, respectively, are mounted into respective mounting apertures 103, 104 on substrate 89, with respective second connecting portions 50, 74 of first and second terminal members 46, 70 being received in corresponding apertures 95, 97 of conductors 92 on substrate 89. As can best be seen in FIG. 3, first terminal members 46 of first connector subassembly 44 are electrically connected to corresponding second terminal members 70 of second connector assembly 68 via corresponding conductors 92 on dielectric substrate member 89. Electrical circuit component members 108 electrically connected to respective conductors 92 provide transient suppression means along respective circuit paths between corresponding first and second terminal members 46, 70. After mounting the first and second connector subassemblies 44, 68, metal ground shield 120 is mounted to substrate 89. Electrical connection of first terminal portions 50, 74; electrical circuit component members 108; grounding strap 114; and metal ground shield 120 can be soldered or otherwise electrically connected to surface 91, by means of conductive adhesive or the like. As can be seen in FIG. 3, all electrical interconnections are preferably made on one side of dielectric substrate member 89.

Assembly of adaptor 10 is completed by adding lower and upper housing members 30, 12, respectively. Substrate subassembly 90 is first mounted to lower housing member 30 by engaging locking means 34 in apertures 107 of dielectric substrate member 89. Upper housing member 12 is then locked into place by engaging locking means 38 of lower housing 30 in corresponding apertures 16 of upper housing sidewalls 14.

Obviously, many modifications may be made without departing from the basic spirit of the present invention. Accordingly, it will be appreciated by those skilled in the art that within the scope of the appended claims, the invention may be practiced in embodiments other than those that have been specifically described herein.

What is claimed is:

1. An electrical adaptor providing transient suppression capabilities comprising:

a dielectric substrate member having a plurality of conductors thereon, said conductors having first, second and intermediate portions;

a first connector subassembly comprising a plurality of first terminal members having first and second connecting portions and a first dielectric support member, said first terminal members being disposed in said first support member, said first support member being configured to mate with a first complementary mating connector such that said first connecting portions of said plurality of first terminal members are electrically engaged with respective complementary terminal members, said first connector subassembly being mounted to said substrate member such that said second connecting portions of said first terminal members are electrically connected to respective first portions of said substrate conductors;

a second connector subassembly comprising a plurality of second terminal members having first and second connecting portions and a second dielectric second support member, said second terminal members being disposed in said second support member, said second support member being configured to mate with a second complementary mating connector such that said first connecting portions of said plurality of second terminal members are electrically engaged with respective complementary terminal members, said second connector subassembly being mounted to said substrate member such that said second connecting portions of said second terminal members are electrically connected to respective second portions of said substrate conductors, thus electrically interconnecting respective first and second terminal members of said first and second connector subassemblies;

electrical circuit component members which alter the voltage of an electrical signal going therethrough, said component members being mounted to said substrate member, each having first and second conductive portions with respective first conductive portions being in electrical engagement with said intermediate portion of a respective one of said substrate conductors;

means for grounding said component members, said grounding means being in electrical engagement with said second conductive portions of said component members; and means for housing said substrate member, first and second connector subassemblies and said electrical circuit component members.

2. The electrical adaptor as defined in claim 1 wherein the first and second connector subassemblies are essentially identical.

3. The electrical adaptor as defined in claim 2, wherein said first and second complementary mating connectors are modular plugs.

4. The electrical adaptor as defined in claim 1; wherein said dielectric substrate member further includes a ground conductive area disposed thereon.

5. The electrical adaptor as defined in claim 4 wherein said ground conductive area and said conductors are disposed on the same side of said dielectric substrate member, said conductors being spaced from said ground conductive area.

6. The electrical adaptor as defined in claim 1 wherein said grounding means includes a grounding strap in electrical engagement with said second conductive portions of said component members.

7. The electrical adaptor as defined in claim 6 wherein said dielectric substrate member further includes a ground conductive area disposed thereon in electrical communication with said grounding strap.

8. The electrical adaptor as defined in claim 6 wherein said grounding means further includes a shield member in electrical communication with said grounding strap, said shield member having means for connection to an external ground.

9. The electrical adaptor as defined in claim 1 wherein said electrical circuit component members are surface mountable bipolar diodes.

10. The electrical adaptor as defined in claim 1 wherein said means for housing comprises upper and lower housing members, said lower housing member including means for securing said dielectric substrate member thereto and said upper housing member having an aperture therein for providing external access to said means for grounding said adaptor.

11. An electrical adaptor providing transient suppression capabilities comprising:

a dielectric substrate member having a plurality of conductors thereon, said conductors having first, second and intermediate portions, said dielectric substrate member further including a ground conductive area disposed thereon;

a first connector subassembly comprising a plurality of first terminal members having first and second connecting portions and a first dielectric support member, said first terminal members being disposed in said first support member, said first support member being configured to mate with a first complementary mating connector such that said first connecting portions of said plurality of first terminal members are electrically engaged with respective complementary terminal members, said first connector subassembly being mounted to said substrate member such that said second connecting portions of said first terminal members are electrically connected to respective first portions of said substrate conductors;

a second connector subassembly comprising a plurality of second terminal members having first and second connecting portions and a second dielectric second support member, said second terminal members being disposed in said second support member, said second support member being configured to mate with a second complementary mating connector such that said first connecting portions of said plurality of second terminal members are electrically engaged with respective complementary terminal members, said second connector subassembly being mounted to said substrate member such that said second connecting portions of said second terminal members are electrically connected to respective second portions of said substrate conductors, thus electrically interconnecting respective first and second terminal members of said first and second connector subassemblies;

electrical circuit component member which alter the voltage of an electrical signal going therethrough, said component members being mounted to said substrate member, each having first and second conductive portions with respective first conductive portions being in electrical engagement with said intermediate portion of a respective one of said substrate conductors;

means for grounding said component members, said said grounding means including a grounding strap in electrical engagement with said second conductive portions of said component members; and means for housing said substrate member, first and second connector subassemblies and said electrical circuit component members.

12. The electrical adaptor as defined in claim 11 wherein the first and second connector subassemblies are essentially identical.

13. The electrical adaptor as defined in claim 12 wherein said first and second complementary mating connectors are modular plugs.

14. The electrical adaptor as defined in claim 11 wherein said ground conductive area and said conductors are disposed on the same side of said dielectric substrate member, said conductors being spaced from said ground conductive area.

15. The electrical adaptor as defined in claim 11 wherein said grounding means further includes a shield member in electrical communication with said grounding strap and said ground conductive area, said shield member having means for connection to an external ground.

16. The electrical adaptor as defined in claim 11 wherein said electrical circuit component members are surface mountable bipolar diodes.

17. The electrical adaptor as defined in claim 11 wherein said means for housing comprises upper and lower housing members, said lower housing member including means for securing said dielectric substrate member thereto and said upper housing member having an aperture therein for providing external access to said means for grounding said adaptor.

18. A subassembly comprising:

a dielectric substrate member having a plurality of conductors thereon, said conductors having first, second and intermediate portions;

a ground conductive area disposed on said dielectric substrate member;

electrical circuit component members which alter the voltage of an electrical signal going therethrough, said component members being mounted to said substrate member, each component member having first and second conductive portions with respective said first conductive portions being in electrical engagement with said intermediate portion of a respective one of said substrate conductors;

means for grounding said component members, said grounding means including a grounding strap overlying and engaging said component members, said strap being in electrical engagement with said second conductive portions of said component members and said ground conductive area.

19. The subassembly as defined in claim 18, wherein said electrical circuit component members are surface mountable.

20. The subassembly as defined in claim 18 wherein said ground conductive area and said conductors are disposed on the same side of said dielectric substrate member, said conductors being spaced from said ground conductive area.

* * * * *

UNITED STATES PATENT AND TRADEMARK OFFICE

CERTIFICATE OF CORRECTION

PATENT NO. : 4,799,901

DATED : January 24, 1989

INVENTOR(S) : Douglas J. Pirc

It is certified that error appears in the above-identified patent and that said Letters Patent is hereby corrected as shown below:

Title page,

Item No. [73]:

---Assignee: AMP Incorporated, Harrisburg, Pa.---

Signed and Sealed this

Twelfth Day of September, 1989

*Attest:*

DONALD J. QUIGG

*Attesting Officer*

*Commissioner of Patents and Trademarks*